US005615942A

United States Patent [19]

Langis

[11] Patent Number: 5,615,942

[45] Date of Patent: Apr. 1, 1997

[54] LIGHT SOCKET ADAPTER

[76] Inventor: John P. Langis, 502 Ossipee Trail, Gorham, Me. 04038

[21] Appl. No.: 461,399

[22] Filed: Jun. 5, 1995

[51] Int. Cl.[6] ..... F21S 3/00

[52] U.S. Cl. ..... 362/220; 362/225; 362/371; 362/812

[58] Field of Search ..... 362/220, 225, 362/260, 371, 812; 248/201, 284.1, 291.1; 40/564

[56] References Cited

U.S. PATENT DOCUMENTS

| | | | |
|---|---|---|---|
| 3,254,205 | 5/1966 | Cobb | 362/220 |
| 3,562,511 | 2/1971 | Reeves | 240/51.12 |
| 4,420,798 | 12/1983 | Herst et al. | 362/147 |
| 4,849,864 | 7/1989 | Forrest | 362/225 |
| 5,291,678 | 3/1994 | Murray | 40/564 |
| 5,504,665 | 4/1996 | Osteen et al. | 362/371 |

OTHER PUBLICATIONS

ABC Extrusion Company, "Large A/Flexframe", 5 pages.

*Primary Examiner*—Ira S. Lazarus
*Assistant Examiner*—Alfred Basichas
*Attorney, Agent, or Firm*—Chris A. Caseiro; Thomas L. Bohan

[57] ABSTRACT

A light socket adapter designed for use with fluorescent tubular lamps. The light socket adapter includes a lamp socket, an adjustable support element, and an adjusting device. The adjusting device includes a first adjusting component connected to the lamp socket and a second adjusting component connected to the support element. The first adjusting component is detachably and rotatably connected to the second adjusting component allowing the positioning of the lamp socket at any desired angle relative to the second adjusting component. The light socket adapter optionally includes a middle connecting component for use between the first adjusting component and the second adjusting component. The middle connecting component allows positioning of the lamp socket at any desired angle relative to the support element.

10 Claims, 6 Drawing Sheets

LIGHT SOCKET ADAPTER

BACKGROUND OF THE INVENTION

1. Field of the Invention

The present invention relates to lighting systems used in signs. In particular, the present invention relates to light sockets used in the lighting systems of indoor and outdoor signs generally observed at commercial establishments. More particularly, the present invention relates to light sockets used in connecting standard-size fluorescent light tubes within indoor and outdoor signs. Yet more particularly, the present invention relates to light sockets used in connecting standard-size fluorescent light tubes which can be adapted to fit within any indoor or outdoor sign, regardless of the shape or size of the light.

2. Description of the Prior Art

Tubular lamp sockets have been around since the development of tubular lamps. The earliest type of socket was designed to accept a fluorescent lamp having two spaced prongs at each end. These sockets were generally circular in design and were connected to a flat surface of a socket support bracket. As the demand for fluorescent lighting systems increased, newer sockets were designed which resulted in the standardization of the light socket. A "tombstone" design was one such standard design. Its name was derived from the socket's appearance. When viewed from one end, the light sockets look like miniature tombstones extending from the sockets' supporting members. This "tombstone" design allowed for the economical manufacturing of various lamp fixture designs.

Because fluorescent lights use less electricity, operating costs are reduced relative to the cost of standard incandescent lighting. This created a relatively large increase in the demand for lighted signs in the commercial marketplace. The basic characterization of lighted signs is that they are all custom-made or extruded signs made of glass, plastic, metal, or any combination of the three, using fluorescent light tubes inside as the means for lighting the sign. The signs are typically made with an aluminum frame housing to which opaque glass or plastic casings are attached. The fluorescent lamp is placed within the casing. Until recently, these signs were usually custom-made, rather than extruded or prefabricated in standard sizes. That is, they were, and for the most part, continue to be, made to meet a particular appearance specification. Fluorescent tubular lamps, on the other hand, do come in standard sizes. Since the size of the aluminum frame and the size of the standard tubes rarely match, it is usually necessary to create essentially unique housings for each tubular lamp so as to adapt the standard-size tubular lamps within the sign casing in a manner to ensure complete illumination of the sign. Given the size of such signs, it is often necessary to include light socket support brackets in conjunction with the housings to ensure stability of the tubular lamps therein. These support brackets are generally custom-made for each particular tubular-lamp socket and each sign may require a variety of custom-made support brackets.

Although there have been some minor changes in the original lamp socket design based on the lamps having a pair of spaced prongs at opposite ends thereof, these changes focused primarily on the type of contacts used for connecting the lamps to a power source. Other design efforts concentrated on the ability to adjust the position of the socket along the socket-support bracket; that is, the light socket and the support bracket were made to allow a unilateral, perpendicular adjustment of the tubular lamp.

U.S. Pat. No. 3,562,511 (1971, Reeves) teaches an elongated socket-supporting element for assembly in a fluorescent lighting fixture. The socket-supporting element of the Reeves device includes a plurality of elongated, aligned, spaced-apart socket guide holes and slidable plates, each having a fluorescent lamp socket, covering each hole. The elongated, socket guide holes allow sliding of the slidable plates toward or away from each other for accommodating the various terminal spacings of conventional U-shaped, hot-cathode fluorescent lamp tubes.

U.S. Pat. No. 4,420,798 (1983, Herst et al.) teaches an adjustable, overhead lighting fixture. The Herst device includes fixed, elongated support runners and a plurality of elongated hanger-fixture elements supported on their ends by any two support runners. The elongated hanger-fixture elements span any two support runners at any point along the length of the runners and are electrified from the runners.

As indicated, these prior sign devices are limited to (1) the structural design of the standard lighting fixture, (2) the structural design of a lamp socket such as the circular or "tombstone" designs, and (3) the artistic appearance of the sign itself. Because of these limitations, all of the prior art devices suffer from the same disadvantages inherent in their designs. Most notable is the cost of manufacturing custom-made signs attributed to the use of currently existing fluorescent lamp sockets. The options available to the sign manufacturer are either (1) to use the standard, straight fluorescent light tubes in a vertical or horizontal arrangement within a "standardized" pre-fabricated sign housing, (2) to use commercially available U-shaped light tubes, or (3) to make a custom sign housing. The disadvantage of option 1 is that a custom-made adapter for a tubular lamp socket is required. Fabrication of each adapter and housing is labor intensive because each one is generally different and each must meet UL lighting standards. These custom-made sockets are specifically designed for the particular sign under construction and entail taking account of the precise layout and fitting of the adapter housing. No allowance can be tolerated for a crooked socket. Consequently, the cost of designing and manufacturing an extruded sign using the standard fluorescent tubes is prohibitive under this option. The alternative is option 2. Unfortunately, the U-shaped tubes are much more expensive than the standard tubes. Again, this added cost makes the custom signs more expensive than they ought to be. A third option to the sign manufacturer, which is not economically efficient, is to make a custom sign housing. None of the prior art devices have addressed this particular aspect of the cost of manufacturing signs of this type. In most cases, the extra costs associated with the use of U-shaped fluorescent tubes and/or custom housings are simply passed along to the customer.

Therefore what is needed is a commercial lighting system that permits the use of standard-size fluorescent light tubes-instead of the more expensive U-shaped tubes-in any type of pre-fabricated or custom-made sign. What is still further needed is a lighting system that provides a fluorescent-tube socket that is adjustable to any angle and height relative to the socket-support bracket, thus allowing one to use the standard, straight, fluorescent-tube lamps regardless of housing size and shape. Finally, what is needed is a commercial lighting system that is inexpensive relative to present arrangements and that is relatively easy to install.

SUMMARY OF THE INVENTION

It is an object of the present invention to provide a light socket adapter for use with standard, tubular lamps that is less expensive than the custom-made adapter sockets, and provides an alternative to using more expensive U-shaped tubular lamps. It is another object of the present invention to provide a light socket adapter that is adjustable. Finally, it is an object of the present invention to provide an adjustable, tubular-lamp socket adapter such that a straight, tubular lamp can be positioned to any angle and height relative to the tubular-lamp socket bracket.

The light-socket adapter of the present invention includes a lamp socket, an adjusting means, and a support element. The lamp socket, which is typically a standardized snap-on or tombstone socket, is connected to the adjusting means. The adjusting means includes a first adjusting component connected to the lamp socket and a second adjusting component connected to the support element. The first adjusting component may be rotatably and detachably connected to the second adjusting component. A locking mechanism connecting the first adjusting component to the second adjusting component allows for quick adjustment of the lamp socket to any angle desired. The adjusting means may further include a conduit for containing a power source means such as electrical ballast wires through which electrical power can be supplied to the tubular lamp. An alternative to this design is to incorporate a pair of concentric, electrical contacts at the junction between the first adjusting component and the second adjusting component. This type of design may well reduce the likelihood of tangled, twisted wires within the conduit caused by adjustment of the lamp angle. The adjusting means may be made from plastic such as polypropylene, polycarbonate, or other polymeric materials. It may also be made from a metallic material. However, plastic is preferred because of its electrical insulating characteristics as well as its rugged, mechanical properties.

Generally, the support element is detachably connected to a support bracket of an extruded sign using fastening means. The support element is also adjustable and allows one to adjust the distance between the adjusting means of the lamp socket and the support bracket of the extruded sign. A threaded tube having two locknuts, one on either side of a support bracket wall, may be used as the support element. As with the adjusting means above, the support element may be constructed of plastic, metal, etc.; however, plastic is the preferred material due to its electrical insulating properties. An adaptive section may be used to make up significant differences in the size of the lamp versus the size of the cabinet containing the lamp.

An obvious advantage of the present invention is the ability to use it with less-expensive, standard, straight fluorescent light tubes as well as U-shaped, fluorescent light tubes. Another advantage arises because of the adjustability of the present invention. Multiple custom-made light-socket brackets are not needed because the present invention offers a single, adjustable adapter that standardizes the light-socket bracket. The present invention allows one to adjust the angle and height of the lamp socket to any required position within the custom-made or pre-fabricated sign. A further advantage is the reduced time required for assembly of custom-made light sockets which require precise layout and fitting of these components within the extruded sign. The ability to use standard fluorescent light tubes without the need to custom fabricate the light socket adapter, or, in the alternative, the need to use U-shaped light tubes which are considerably more expensive than the standard light tubes, enables a manufacturer to reduce its cost of manufacturing by reducing material and labor costs.

DETAILED DESCRIPTION OF THE PREFERRED EMBODIMENT

Figure 1:
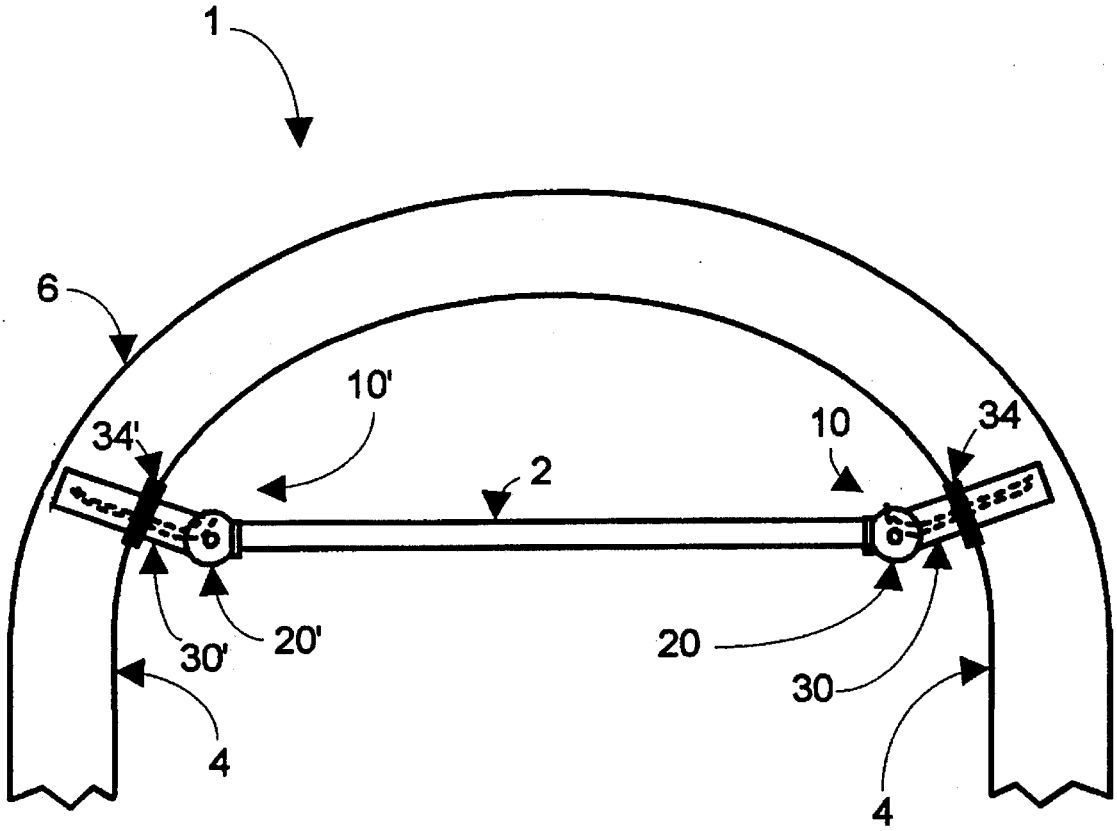
FIG. 1 is a side view of a set of light socket adapters of the present invention, shown connecting a lamp within a sign housing.
Figure 2:
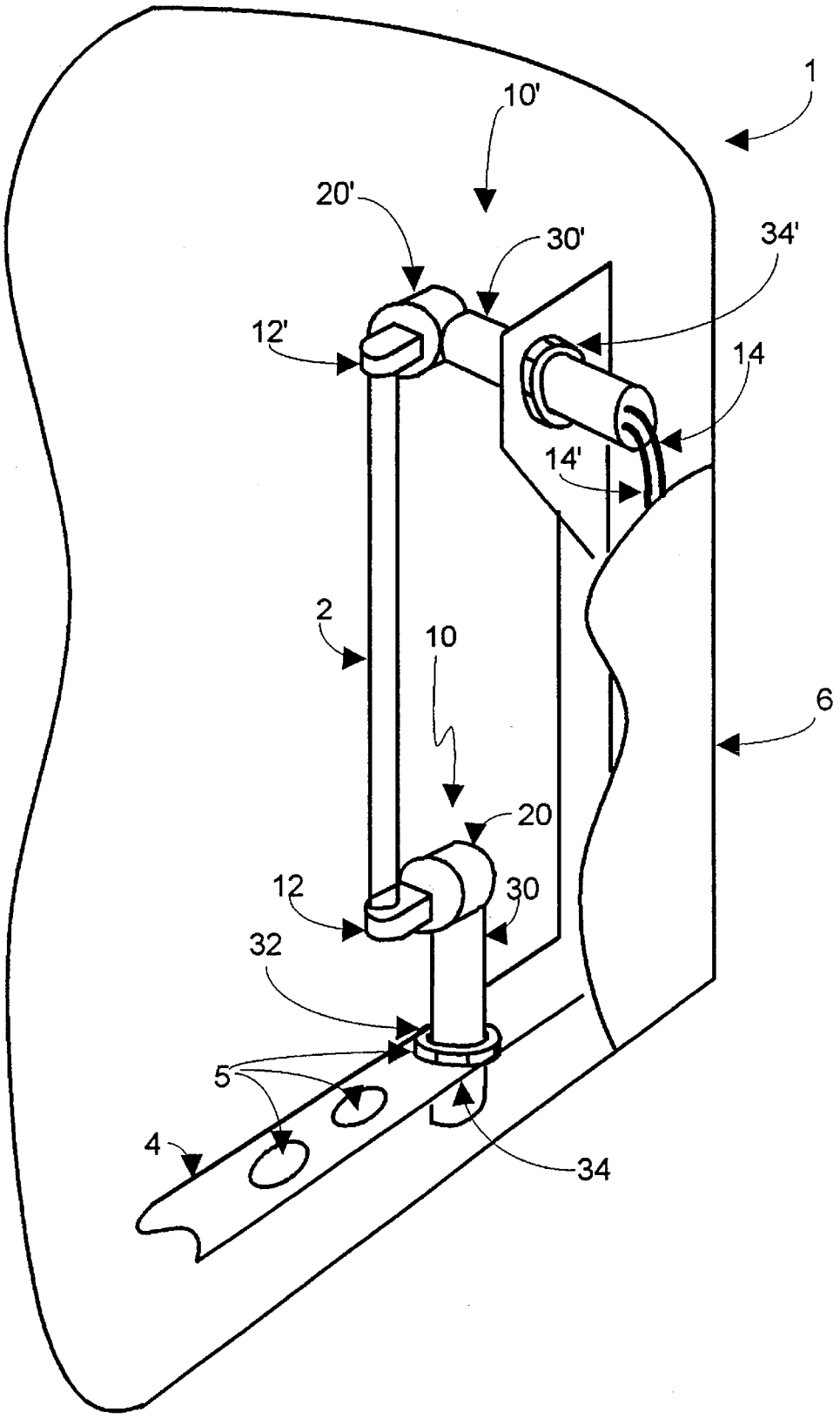
FIG. 2 is a perspective, cut-away view of the present invention showing its use within a custom-made or an extruded sign.

The preferred embodiment of the present invention is illustrated in FIGS. 1–5. As shown in FIGS. 1 and 2, a sign 1 includes a bracket wall 4, a light adapter socket 10 that is the focus of the present invention, and a fluorescent tubular lamp 2, all positioned within a sign housing 6. The light adapter socket 10 includes a lamp socket 12, an adjusting means 20, and a support element 30. Each lamp 2 utilizes two adapter sockets. While the detailed description of the invention will focus on one end of the lamp 2 inserted into one of the adapter sockets, it is to be understood that the other end of the lamp 2 is insertable into a second lamp adapter socket 10' having a second lamp socket 12', a second adjusting means 20', and a second support element 30', wherein the designs are symmetrical.

Figure 3:
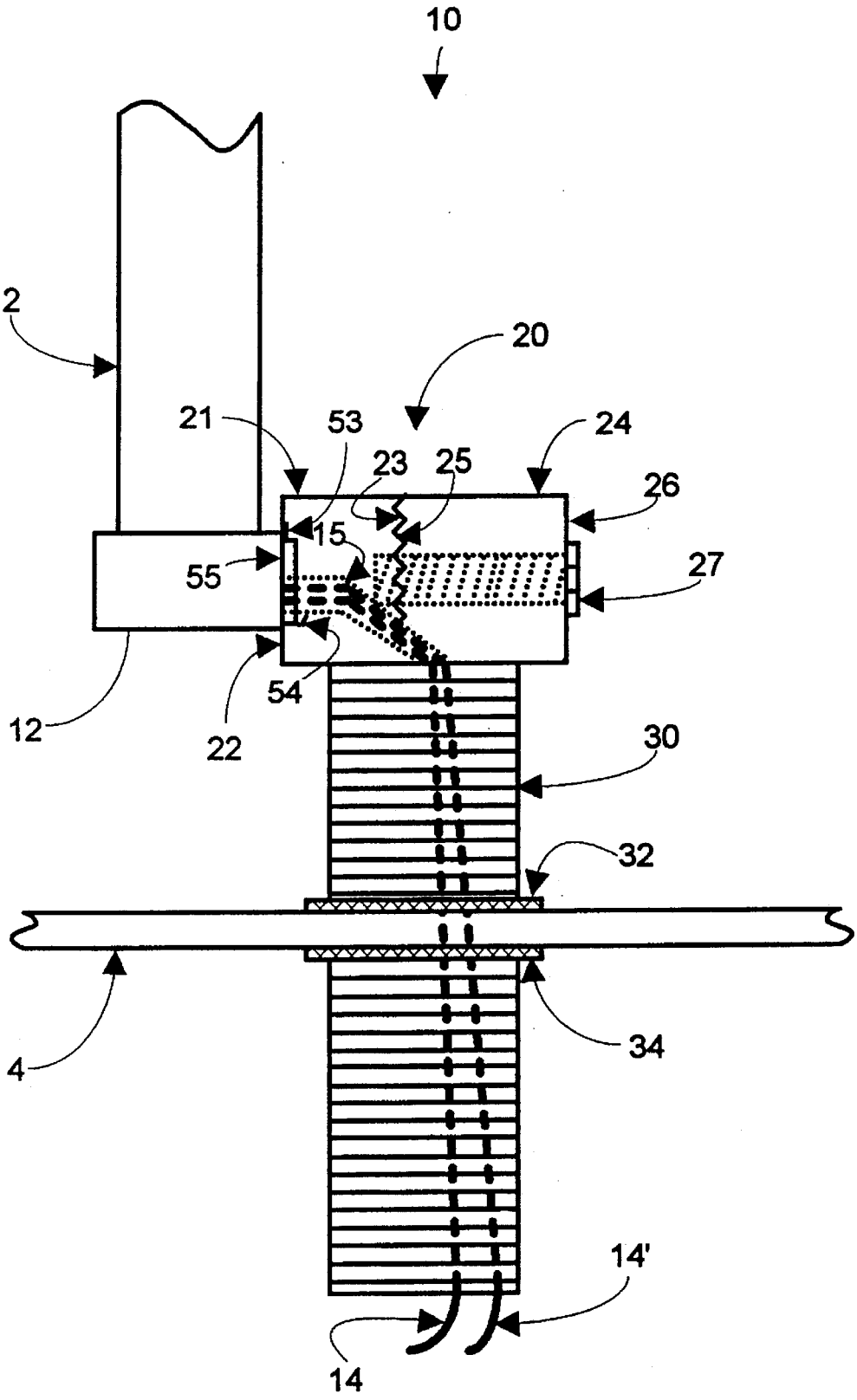
FIG. 3 is a side view of the present invention showing the tubular lamp socket, the adjusting means, and the support element assembled on a metal wall of a support bracket.
Figure 4A:
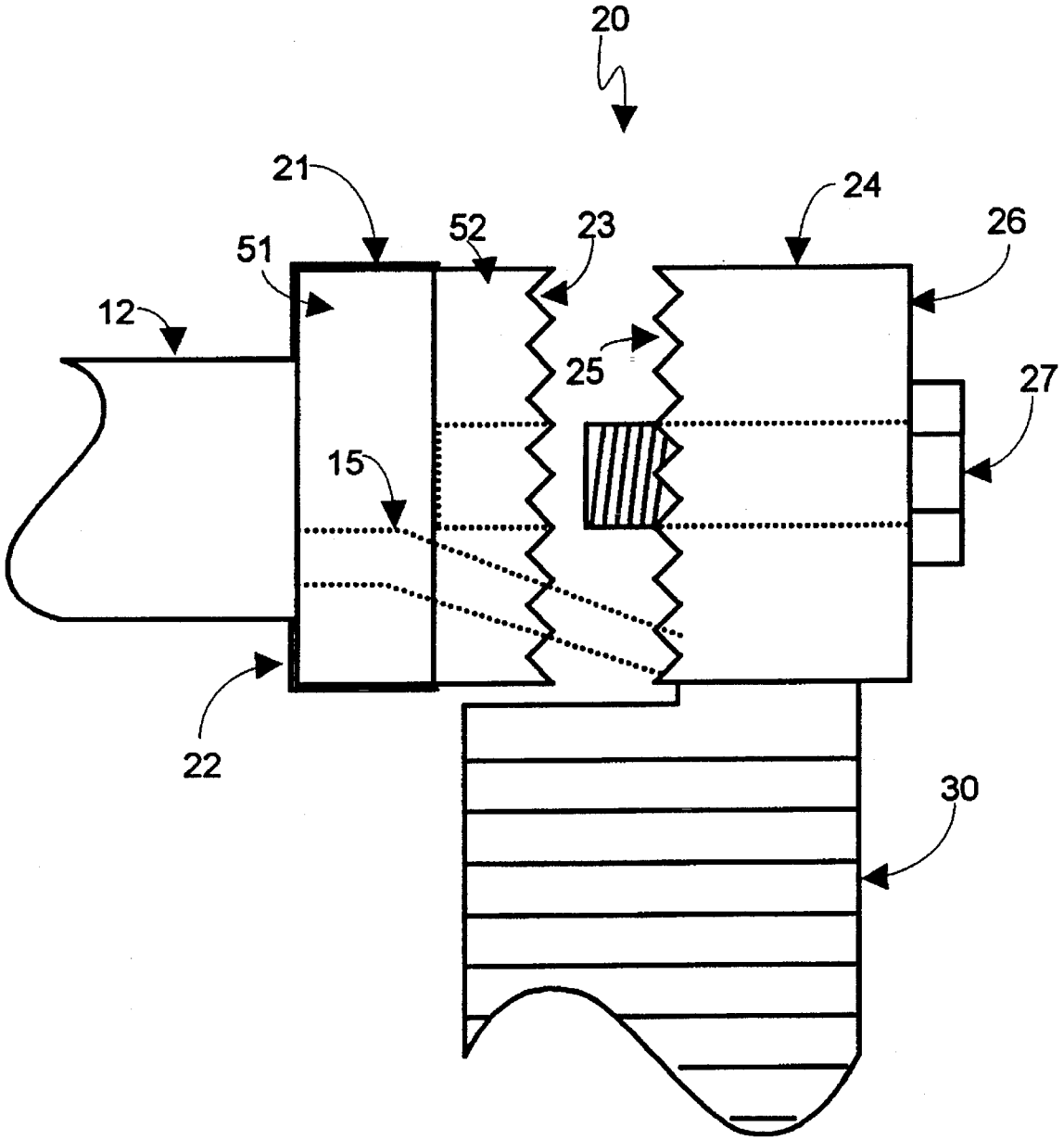
FIG. 4A is an expanded side view of adjusting means of the present invention showing the first adjusting component separated from the second adjusting component.
Figure 4B:
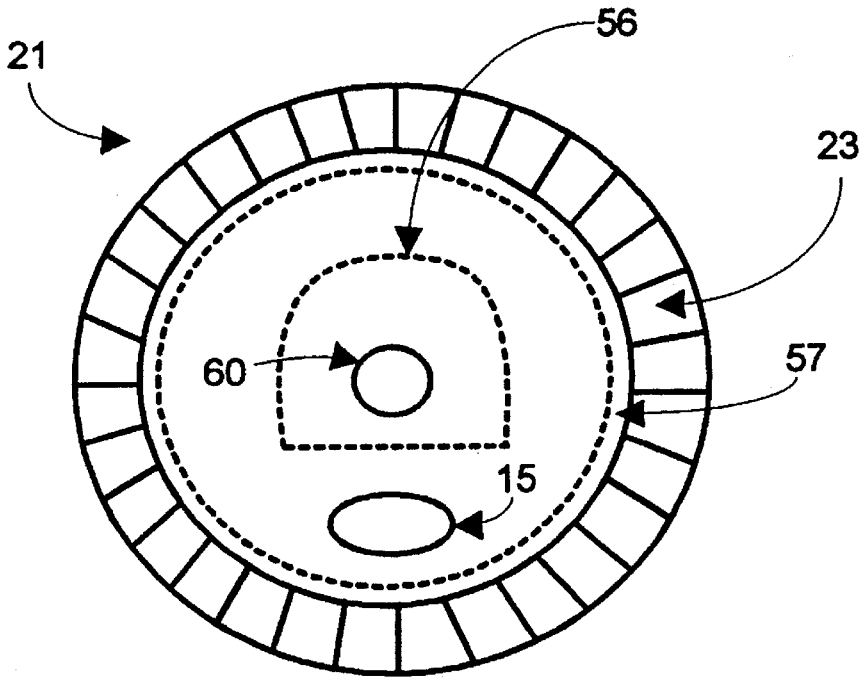
FIG. 4B is an end view of the first adjusting component of the present invention, showing an optional D-punch opening for receiving the lamp socket.
Figure 4C:
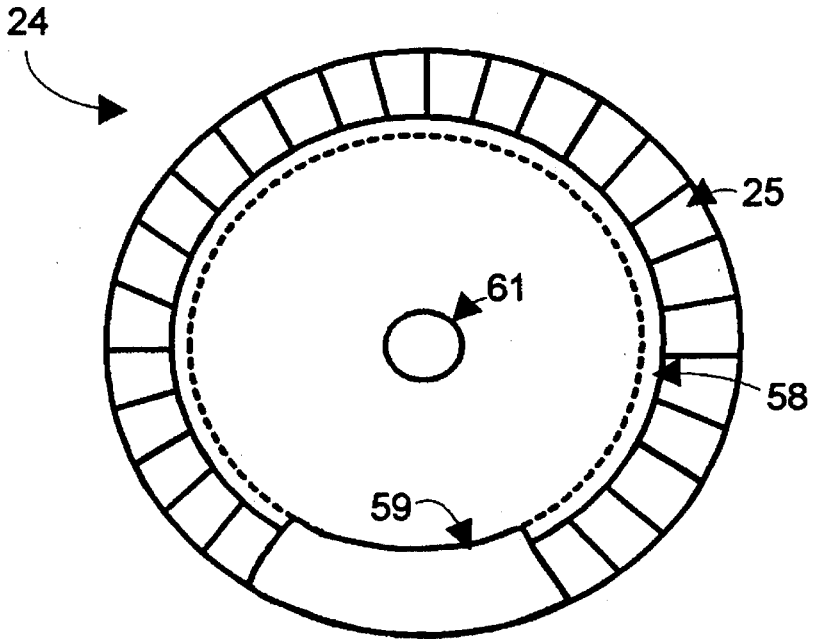
FIG. 4C is an end view of the second adjusting component of the present invention, showing the opening for ballast wires.

As illustrated in FIGS. 3–4C, the adjusting means 20 includes a first adjusting component 21 having a socket end 22 and a first component mating end 23 with a first fastener opening 60, a second adjusting component 24 having a second component mating end 25 with a second fastener opening 61, a fastening means end 26, a fastening means 27, and a conduit 15. The fastening means 27 may be one of a variety of securing devices such as a threaded bolt, a self-locking pin, a mechanism having pair of self-locking arms, and the like. The lamp socket 12 is removably affixed to the socket end 22 of the first adjusting component 21. Various mechanisms for securing lamp socket 12 may be used. Lamp socket 12 may be threaded or it may have a plurality of self-locking arms which engage corresponding receptacles within first adjusting component 21. The first socket end 22 may be solid with just the conduit 15 located therein, or it may have a first portion 51 that is optionally hollow for accepting the lamp socket 12, and a second portion 52 that is solid. The first hollow portion 51 may include a metal facing for creating a socket opening, such as a D-punch opening. Although the lamp socket 12 may be permanently affixed to the first adjusting component 21, it is preferable that the lamp socket 12 be removable in the event that it becomes damaged. As previously indicated, the adjusting means 20 may be fabricated of any of a variety of materials, including plastics and metals. In selecting the materials of fabrication, it is to be understood that some regions may have to be insulative while others may have to be conductive.

When the lamp socket 12 is of the type having a "D" connector design, and the first portion 51 is at least partially hollow, a first socket clip 53 and a second socket clip 54 may be used to removably join a socket connector 55 to the interior of the socket end 22 of the first adjusting component 21. As illustrated in FIG. 4B, optional D-punch opening 56 located within the first portion 51 is designed to accept the D-type socket. It is also to be noted that the first mating component end 23 may include a first recessed region 57 at the perimeter in order to more firmly join the first adjusting component 21 to the second adjusting component 24.

When fastening means 27 is fully engaged, the first component mating end 23 of first adjusting component 21 and the second component mating end 25 of second adjusting component 24 are integrally connected to each other. Loosening of the fastening means 27 allows the first adjusting component 21 to rotate either clockwise or counterclockwise relative to the position of the second adjusting component 24. Furthermore, fastening means 27 also allows complete separation of the first adjusting component 21 from the second adjusting component 24 should replacement of either component become necessary. As illustrated in FIG. 4C, the second adjusting component 24 may also include a second recessed region 58 and a wide conduit gap 59 for receiving ballast wires 14 and 14' shown in FIG. 3.

As illustrated in FIG. 3, the support element 30 includes a first securing means 32 and a second securing means 34. The first securing means 32 and the second securing means 34 hold the light socket adapter 10 of the present invention to the bracket wall 4 by sandwiching the bracket wall 4 between the first securing means 32 and the second securing means 34, respectively. The support element 30 may be made from material such as plastic, metal, and the like, but must be of sufficient strength to support the light socket adapter 10 and the tubular lamp 2. For example, support element 30 may simply be a plastic, threaded tube with self-locking nuts as securing means 32 and 34, respectively. On the other hand, a smooth tube may be used as support element 30 in conjunction with a pair of set screw rings on either side of the bracket wall 4. In the preferred embodiment of the present invention, the support element 30 is affixed to the second adjusting component 24. It is to be understood that the bracket wall 4 may come in different thicknesses. When the bracket wall 4 is relatively thin, a more robust first securing means 32 and a more robust second securing means 34 will likely be required in order to adequately stabilize the adapter socket 10. Similarly, the second adapter socket 10' would require more robust securing components 32' and 34' as well for a thinner bracket wall 4.

Ballast wires 14 and 14' supply power to the tubular lamp 2. As shown in FIG. 3, ballast wires 14 and 14' are detachably connected to lamp socket 12 and pass through conduit 15 and support element 30. The ballast wires 14 and 14' are sufficiently long enough to allow separation of first adjusting component 21 from second adjusting component 24 without the need for detaching them from lamp socket 12.

FIG. 4A shows an expanded side view of the adjusting means 20 of the preferred embodiment of the present invention. In the drawing, the first adjusting component 21 is shown separated from the second adjusting component 24. The first component mating end 23 and the second component mating end 25 are preferably serrated-type surfaces to insure proper mating and securing of the two adjusting components, 21 and 24, to each other. The actual design of the serrated surfaces may be geared, tongue and groove, nipple and dimple, or any other similar design which will effectively prevent the first adjusting component 21 from slipping from its fixed position relative to the second adjusting component 24 when the fastening means 27 is fully engaged. However, it should be obvious to those skilled in the art that other friction-enhancing surfaces may be used between the first component mating end 23 and the second component mating end 25. An example would be the use of a non-slip disc made of material having a high coefficient of friction such as rubber, vinyl, and the like.

Figure 5:
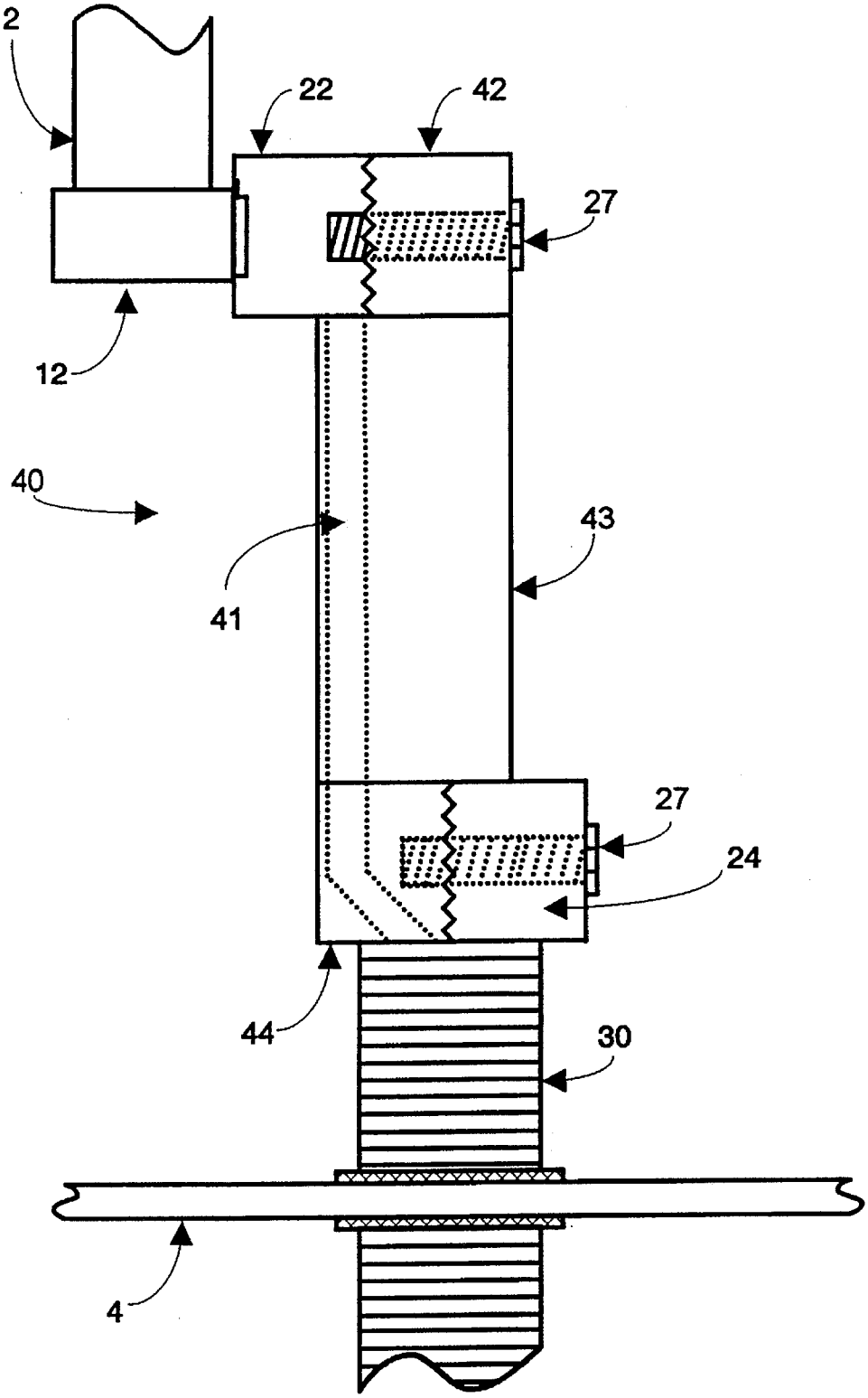
FIG. 5 is a side view of the middle connecting component of the present invention.

As illustrated in FIG. 5, the light socket adapter 10 may further include a middle connecting component 40. The middle connecting component 40 includes a third adjusting component 42, a fourth adjusting component 44, and a connecting member 43. Use of this middle connecting component 40 allows one to adjust the angle of the lamp socket 12 to any position relative to bracket wall 4. The preferred embodiment of the middle connecting component 40 includes a conduit path 41 through which the insulated, electrical wires 14 and 14' can pass.

The light socket adapter 10 of the present invention is assembled in the following way. The first securing means 32 is attached to the support element 30. The support element 30 is then inserted into a sized hole 5 within the bracket wall 4. The second securing means 34 is attached to the support element 30 and tightened, thus firmly securing the support element 30 to the bracket wall 4 of sign 1. The first adjusting component 21 is then positioned such that the first component mating end 23 is aligned with and contacting the second component mating end 25 of the second adjusting component 24. First adjusting component 21 is rotated either clockwise or counterclockwise relative to the second adjusting component 24 until the desired angle or position is attained. Fastening means 27 is then connected to the second adjusting component 24 and fully engaged, thereby securing the first adjusting component 21 to the second adjusting component 24. The second light socket adapter 10' having the same design as light socket adapter 10 is located within sign 1 and attached to the bracket wall 4 at a second location. This second light socket adapter 10' is adjusted in a similar manner as the first light socket adapter 10.

Although the preferred embodiment of the present invention has been described herein, the above description is merely illustrative. Further modification of the invention herein disclosed will occur to those skilled in the respective arts and all such modifications are deemed to be within the scope of the invention as defined by the appended claims.

What is claimed is:

1. A light socket adapter for use with fluorescent tubular lamps within a sign housing, said adapter comprising:

a) a lamp socket accepting section;

b) an adjusting means having a first end connectable to one end of a lamp socket positionable within said lamp socket accepting section; and c) an adjustable support element for attaching said adjusting means to an internal bracket wall of a sign housing wherein said support element is directly connected to a second end of said adjusting means so that said first end and said second end are rotatable with respect to one another while simultaneously linearly adjustable together via linear displacement of said support element.

2. The light socket adapter as claimed in claim 1 wherein said lamp socket is detachably connectable to said adjusting means.

3. The light socket adapter as claimed in claim 1 wherein said adjusting means includes:

a) a first adjusting component connectable to said lamp socket at said one end;

b) a second adjusting component in communicating contact with a second end of said first adjusting component; and c) a fastening means holding said first adjusting component to said second adjusting component.

4. The light socket adapter as claimed in claim 1 wherein said support element includes securing means for securing said support element to said sign housing.

5. The light socket adapter as claimed in claim 1 wherein said light socket adapter further includes a middle connecting component for use between said first adjusting component and said second adjusting component.

6. The light socket adapter as claimed in claim 5 wherein said middle connecting component includes:

a) a third adjusting component;

b) a fourth adjusting component; and c) a middle connecting member affixed to said third adjusting component on a first end of said middle connecting member and affixed to said fourth adjusting component on a second end of said middle connecting member.

7. The light socket adapter as claimed in claim 6 wherein said middle connecting component further includes fastening means.

8. A fluorescent light socket adapter kit for use in signs, said kit comprising:

a) a lamp socket;

b) a support element; and c) an adjusting means having a first end and a second end, wherein said adjusting means is connectable to said lamp socket at said first end and to said support element at said second end so that said first end and said second end are rotatable with respect to one another while simultaneously linearly adjustable together via linear displacement of said support element.

9. The fluorescent light socket adapter kit as claimed in claim 8 wherein said kit further includes a middle connecting component for use between said lamp socket and said support element.

10. A fluorescent light socket adapter for use in signs comprising:

a) a lamp socket;

b) an adjusting means having a first adjusting component in communicating contact with a second adjusting component, wherein said first adjusting component is detachably connected on one end to said lamp socket; and c) a support element connected to said second adjusting component so that said first adjusting component and said second adjusting component are rotatable with respect to one another while simultaneously linearly adjustable together via linear displacement of said support element.

* * * * *